US008177945B2

(12) United States Patent
Arvin et al.

(10) Patent No.: US 8,177,945 B2
(45) Date of Patent: May 15, 2012

(54) MULTI-ANODE SYSTEM FOR UNIFORM PLATING OF ALLOYS

(75) Inventors: Charles L. Arvin, Poughkeepsie, NY (US); Raschid J. Bezama, Mahopac, NY (US); Harry D. Cox, Rifton, NY (US); Krystyna W. Semkow, Poughquag, NY (US)

(73) Assignee: International Business Machines Corporation, Armonk, NY (US)

( * ) Notice: Subject to any disclaimer, the term of this patent is extended or adjusted under 35 U.S.C. 154(b) by 1261 days.

(21) Appl. No.: 11/627,494

(22) Filed: Jan. 26, 2007

(65) Prior Publication Data

US 2008/0179192 A1 Jul. 31, 2008

(51) Int. Cl.
*C25B 9/00* (2006.01)

(52) U.S. Cl. ..... 204/242; 205/96; 205/238

(58) Field of Classification Search ..... 204/242; 205/238

See application file for complete search history.

(56) References Cited

U.S. PATENT DOCUMENTS

| | | | | |
|---|---|---|---|---|
| 1,920,964 | A * | 8/1933 | Burns | 205/256 |
| 1,960,029 | A * | 5/1934 | Russell | 205/256 |
| 2,397,522 | A * | 4/1946 | Baier | 205/241 |
| 3,880,725 | A * | 4/1975 | Van Raalte et al. | 205/95 |
| 3,926,772 | A | 12/1975 | Cordone et al. | |
| 4,462,874 | A * | 7/1984 | Tomaszewski et al. | 205/292 |
| 4,832,812 | A | 5/1989 | Brown | |
| 5,049,246 | A * | 9/1991 | Hull et al. | 205/80 |
| 5,102,521 | A * | 4/1992 | Usuda et al. | 204/198 |
| 5,755,013 | A | 5/1998 | Fitch et al. | |
| 6,156,169 | A | 12/2000 | Yang et al. | |
| 6,190,530 | B1 | 2/2001 | Brodsky et al. | |
| 6,224,721 | B1 * | 5/2001 | Nelson et al. | 204/272 |
| 6,685,814 | B2 | 2/2004 | Uzoh et al. | |
| 6,805,786 | B2 * | 10/2004 | Tran et al. | 205/91 |
| 2002/0008034 | A1 * | 1/2002 | Chen et al. | 205/82 |
| 2003/0079995 | A1 * | 5/2003 | Contolini et al. | 205/118 |

FOREIGN PATENT DOCUMENTS

JP 2006257492 A * 9/2006

OTHER PUBLICATIONS

Machine Translation of JP 2006-257492.*

* cited by examiner

*Primary Examiner* — Harry D Wilkins, III
*Assistant Examiner* — Bryan D. Ripa
(74) *Attorney, Agent, or Firm* — Gibb I.P. Law Firm, LLC; Wenjie Li, Esq.

(57) ABSTRACT

Disclosed are embodiments of an electroplating system and an associated electroplating method that allow for depositing of metal alloys with a uniform plate thickness and with the means to alter dynamically the alloy composition. Specifically, by using multiple anodes, each with different types of soluble metals, the system and method avoid the need for periodic plating bath replacement and also allow the ratio of metals within the deposited alloy to be selectively varied by applying different voltages to the different metals. The system and method further avoids the uneven current density and potential distribution and, thus, the non-uniform plating thicknesses exhibited by prior art methods by selectively varying the shape and placement of the anodes within the plating bath. Additionally, the system and method allows for fine tuning of the plating thickness by using electrically insulating selectively placed prescribed baffles.

20 Claims, 9 Drawing Sheets

MULTI-ANODE SYSTEM FOR UNIFORM PLATING OF ALLOYS

BACKGROUND

1. Field of the Invention

The embodiments of the invention generally relate to electrodeposition of alloys and, more particularly, to a multi-anode system and method for electrodeposition of alloys.

2. Description of the Related Art

Generally, electrodeposition is a process in which, a workpiece to be plated is placed in a plating container with a plating solution (i.e., plating bath). An electrical circuit is created when a negative terminal of a power supply is connected to the workpiece so as to form a cathode and a positive terminal of the power supply is connected to another metal in container so as to form an anode. The plating material is typically a stabilized metal specie (e.g., a metal ion) in the solution. During the plating process this metal specie is replenished with a soluble metal that forms the anode and/or can be added, directly to the solution (e.g., as a metal salt). When an electrical current is passed through the circuit, metal ions in the solution take-up electrons at the workpiece and a layer of metal is formed on the workpiece.

Several methods have been developed for depositing an alloy of two or more different metals (e.g., nickel and cobalt) on a workpiece, based on the above-described electrodeposition process. In one method, a single anode is used that comprises one of the plating metals and any additional plating metals are contained in the plating bath. However, to control the composition and residual stress of the deposited alloy, the plating hath requires frequent chemical additions and eventual dumping. That is, the level of the metal salts in the plating hath buildup over time and in order to keep the metal salt concentrations within normal plating levels, the plating bath must be periodically removed and replaced. If this is not done, the residual stress of the deposit will increase. In another method, an anode that comprises an alloy with the predetermined metal ratio is used. The use of the alloy anode, resolves the need for chemical additions and periodic dumping of the plating bath. However, it is basically impossible to modify the alloy metal ratio once the electrodeposition process has started because the ratio of the deposited alloy is for the most part determined by the ratio of the metals in the anode. In yet another method, multiple rectangular-shaped anodes are placed against one side of the container and spaced apart, as illustrated in FIG. 1. These rectangular-shaped anodes comprise different type metals and are connected to separate voltage sources. This method allows the ratio of metals in the alloy plate to be selectively controlled by applying different current values to anodes with different type metals. However, varying currents in this manner produces a non-uniform voltage profile in the plating bath that typically results in both a non-uniform alloy composition and a non-uniform thickness as compared to the above-described methods. Therefore, there is a need in the art for an electroplating system and an associated electroplating method for depositing metal alloys that does not require periodic plating bath removal or an alloy anode and that does allow for both deposition thickness control and dynamic metal ratio control.

SUMMARY

In view of the foregoing, disclosed herein are embodiments of an electroplating system and an associated electroplating method that allow for depositing of metal alloys with a uniform plate thickness and with the means to dynamically alter the alloy composition (i.e., the ratio of two or more metals within the alloy). Specifically, by using multiple anodes, each with different types of soluble metals, the system and method avoid the need for periodic plating bath replacement and also allow the ratio of metals within the deposited alloy to be selectively varied by applying different voltages to the different metals. The system and method further avoids the uneven current density and potential distribution and, thus, the non-uniform plating thickness of prior art methods by selectively varying the shape and placement of the anodes within the plating bath. Additionally, the system and method allows for fine tuning of the plating thickness by using electrically insulating baffles.

More particularly, each of the embodiments of the alloy plating system comprises a plating container that is adapted to contain a plating solution as well as to hold the workpiece that is to be plated immersed within the solution. The system further comprises a plurality of anode layers on a wall of the container opposite a first side of the workpiece. Theses anode layers provide the metal for uniform plating of the workpiece. The anode layers in each embodiment comprise at least two different types of metal anodes (e.g., first anode(s) comprising a first soluble metal, second anode(s) comprising a second soluble metal, third anode(s) comprising a third soluble metal, etc.). The different types of anodes are each connected to different power sources in order to vary the alloy composition. Furthermore, the anodes can comprise solid metal anodes and/or non-metal or non-soluble metal containers that have a plurality of openings (e.g., baskets) and that are filled with multiple pieces of the selected soluble metal. However, the plating system of the present invention and, particularly, the anodes of the plating system of the present invention differ from the prior art systems because the size, shape, numbers, placement of the anodes within the plating bath, etc., are selectively varied. By selectively varying these features a user can achieve the desired alloy composition and can simultaneously ensure an approximately uniform current density and potential distribution within the solution in the area adjacent the workpiece in order to obtain a uniform plating thickness. The different embodiments vary based on the position and configuration of the anodes within a plurality of anode layers.

In one embodiment of the system, anodes in the same layer comprise the same soluble metal, but the metal may vary from layer to layer. For example, a first anode layer with at least one first anode comprising a first soluble metal can be positioned adjacent to a wall in the plating bath, a second anode layer with at least one second anode comprising a second soluble metal can be positioned adjacent to the first anode layer, etc. The anodes in adjacent anode layers overlap. Furthermore, based on the desired alloy composition and on the space available in the container, various anode features are predetermined. These features include, but are not limited to, the relative surface areas of the different metals, the three dimensional shape of the anodes (e.g., trapezoidal, triangular, rectangular and/or cylindrical three-dimensional shapes), the size of the anodes, the total number of anodes, the number of anode layers, the number of anodes in each layer, etc. These features are specifically predetermined so that, when different voltages are applied to the different metals during the plating process, the desired alloy composition is achieved and the current density and potential distribution remain approximately uniform within the solution in an area adjacent to the first side of the workpiece to ensure a uniform plating thickness.

In another embodiment of the system, each of the anode layers can comprise multiple anodes and, specifically, anodes comprising different soluble metals can be dispersed throughout the anode layers. For example, one anode layer can have a first anode(s) comprising a first soluble metal and second anode(s) comprising a second soluble metal that is different from the first soluble metal. Another layer can comprise first anode(s) and third anode(s) comprising a third soluble metal that is different from the first and/or second soluble metals, in yet another layer, all of the anodes can comprise the same soluble metal (e.g., can comprise first anodes). As with the previously described system embodiment, the anodes in adjacent anode layers overlap. Furthermore, again based on the desired alloy composition and on the space available in the container, various anode features are predetermined. These features include, but are not limited to, the relative surface areas of the different metals, the three dimensional shape of the anodes, the size of the anodes, the total number of anodes, the number of anode layers, the number of anodes of each metal type in each layer, etc. These features are specifically predetermined so that when different voltages are applied to the different metals during the plating process, the desired alloy composition is achieved and the current density and potential distribution remain approximately uniform within the solution in an area adjacent to the first side of said workpiece to ensure a uniform plating thickness.

In yet another embodiment of the system, each of the anode layers can comprise a plurality of multi-anode structures, where each anode in the multi-anode structure comprises a different soluble metal. For example, a multi-anode structure can comprise a first anode that comprises a first soluble metal and that is surrounded by a second anode that comprises a second soluble metal that is different from the first soluble metal. The first and second anodes can each comprise either a non-metal or a non-soluble metal basket (i.e., a container with holes). The basket of the first anode can be filled with pieces of the first metal and can be nested within the basket of the second anode which can further be filled with the second metal. The multi-anode structures in adjacent anode layers overlap. Furthermore, as with the previously described embodiments, based on the desired alloy composition and on the space available in the container, various anode features are predetermined. These features include, but are not limited to, the relative surface areas of the different metals, the three dimensional shape of the multi-anode structures and, specifically, the shapes of the first and second anodes that make up the multi-anode structures, the relative sizes of the first and second anodes, the total number of multi-anode structures, the number of anode layers, the number of multi-anode structures in each layer, etc. These features are specifically predetermined so that when different voltages are applied to the different anodes during the plating process, the desired alloy composition is achieved and the current density and potential distribution remain approximately uniform within the solution in an area adjacent to the first side of the workpiece to ensure a uniform plating thickness.

Each of the above-described embodiments can further comprise at least one baffle in the plating bath adjacent to the workpiece. The baffle(s) can comprise a dielectric material and can be configured so that their dimensions and positions within the container relative to the workpiece will enable current flux control. Adjusting the baffle position allows for fine tuning of the uniform current density and potential distribution in the solution in the area adjacent to the workpiece so as to selectively vary the overall plating thickness distribution.

Also disclosed are embodiments of associated methods for uniform plating of a workpiece with an alloy of two or more metals. The embodiments comprise providing a plating container (i.e., a plating tank) that is adapted to contain a plating solution as well as to hold the workpiece that is to be plated within the solution.

Then, the space available in the tank and the desired alloy composition are determined. Based on the desired alloy composition, the required relative surface areas of the alloy metals are determined.

Then, based on the space available in the tank, the desired alloy composition and on the required relative surface areas, several other predeterminations are made regarding features of the anodes. These predeterminations include, but are not limited to, the following: (1) the three dimensional shape of the anodes (e.g., trapezoidal, triangular, rectangular and/or cylindrical three-dimensional shapes, as illustrated in FIGS. 5*a-e*); (2) the relative number of anodes with different types of metals (e.g., the number of first anodes comprising a first soluble metal, second anodes comprising a second soluble metal, etc.); (3) the configurations of the anodes (e.g., single anode structures (e.g., as illustrated in embodiments 300 and 700, described above) or multi-anode structures (e.g., as illustrated in embodiment 800, described above); (4) the sizes of the anodes; (6) the number of anode layers; the numbers of different types of anodes in each layer; (7) the positions of the different types of anodes within each of the layers; (8) the size and location of baffles; etc. These predeterminations are made specifically so that when different voltages are subsequently applied to the different anodes during the plating process, the desired alloy composition is achieved and current density and potential distribution remain approximately uniform in the solution in an area adjacent to the first side of the workpiece to ensure a uniform plating thickness.

Then, based on these predeterminations, multiple anodes are formed in overlapping layers in the container adjacent to one or more of the container walls. Different type metal anodes are connected to different voltage sources and the plating process is performed. During this plating process, the voltages applied to the different type metal anodes can be selectively varied so as to selectively vary the ratio the different metals in the alloy being deposited on the workpiece. Additionally, the current density and potential distribution in the solution can be fined tuned in the area adjacent to the workpiece using selectively placed prescribed baffles. This fine tuning can be done to control the overall thickness of the uniformly deposited plating.

These and other aspects of the embodiments of the invention will be better appreciated and understood when considered in conjunction with the following description and the accompanying drawings. It should be understood, however, that the following descriptions, while indicating preferred embodiments of the invention and numerous specific details thereof, are given by way of illustration and not of limitation. Many changes and modifications may be made within the scope of the embodiments of the invention without departing from the spirit thereof, and the embodiments of the invention include all such modifications.

BRIEF DESCRIPTION OF THE DRAWINGS

The embodiments of the invention will be better understood from the following detailed description with reference to the drawings, in which.

DETAILED DESCRIPTION OF PREFERRED EMBODIMENTS

Figure 1:
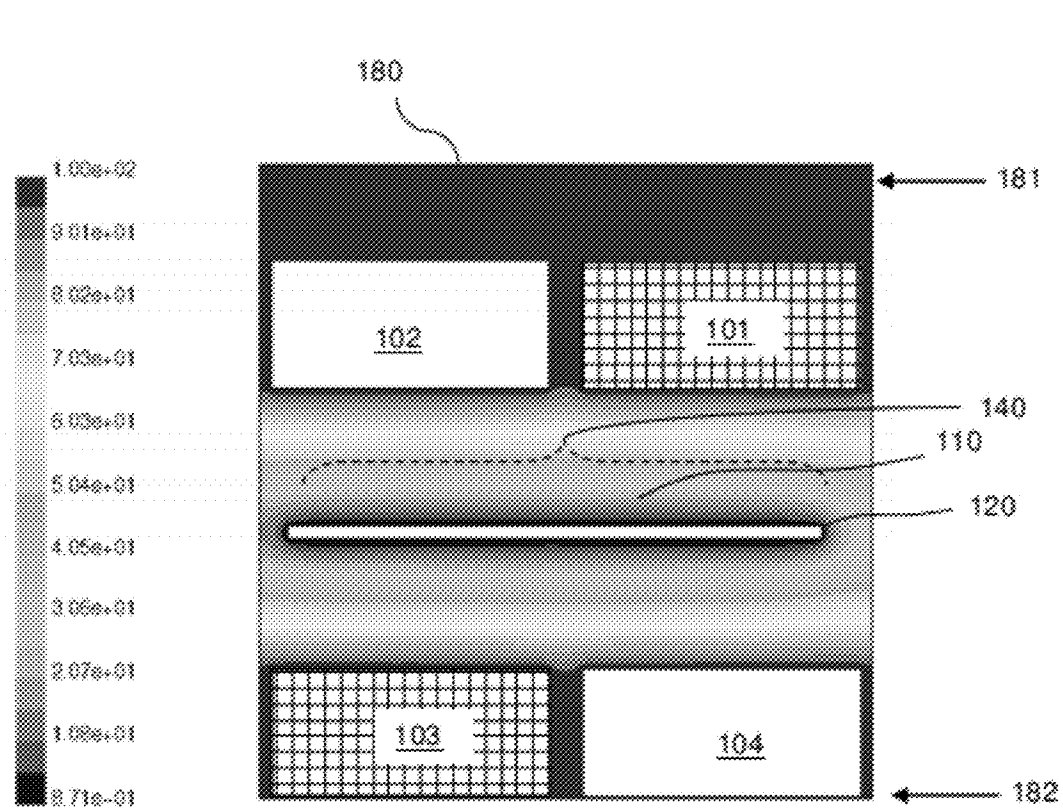
FIG. 1 is a schematic diagram illustrating contours of relative differential voltage exhibited by an exemplary alloy plating system when the same voltage value is applied to all anodes.

The embodiments of the invention and the various features and advantageous details thereof are explained more fully with reference to the non-limiting embodiments that are illustrated in the accompanying drawings and detailed in the following description. It should be noted that the features illustrated in the drawings are not necessarily drawn to scale. Descriptions of well-known components and processing techniques are omitted so as to not unnecessarily obscure the embodiments of the invention. Also, it should be understood that all voltage references, in volt %, are used herein to represent the percent of the voltage differential between the working voltage of one of the anodes and the cathode. The examples used herein are intended merely to facilitate an understanding of ways in which the embodiments of the invention may be practiced and to further enable those of skill in the art to practice the embodiments of the invention. Accordingly, the examples should not be construed as limiting the scope of the embodiments of the invention.

There is a need in the art for an alloy electroplating system and an associated alloy electroplating method. Specifically, an alloy electroplating system is needed that does not require periodic plating bath removal or an alloy anode. An alloy electroplating system that allows for both deposition thickness control and metal ratio control is also needed.

Figure 2:
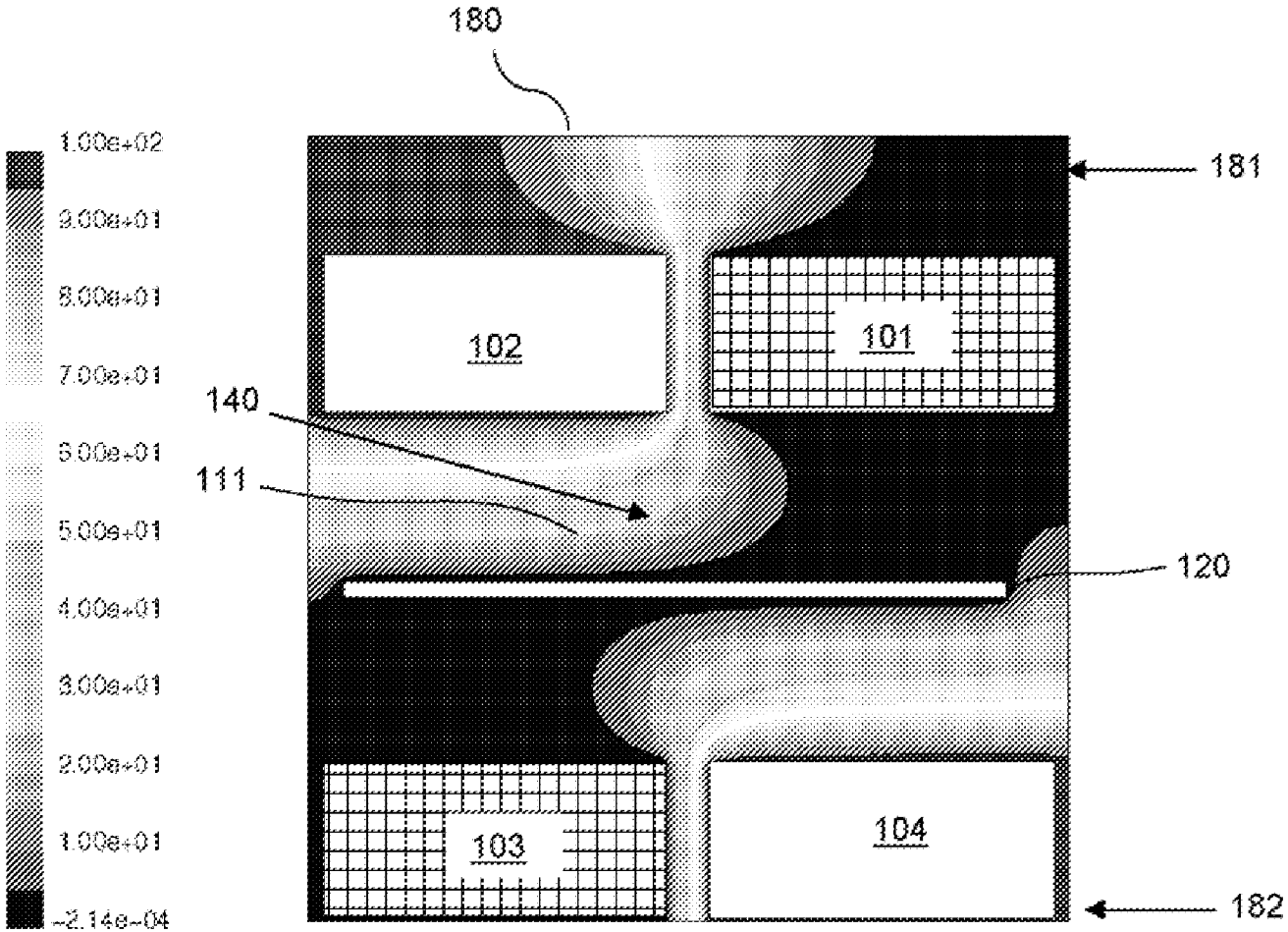
FIG. 2 is a schematic diagram illustrating contours of relative differential voltage exhibited by the alloy plating system of FIG. 1 when different voltages are applied to different metal type anodes.

As mentioned above and illustrated in FIGS. 1 and 2, one method of electrodeposition of an alloy that does not require an alloy anode or periodic plating bath removal involves the use of multiple rectangular-shaped anodes 101-102, 103-104 comprising different soluble metals (e.g., anodes 101 and 103 comprise a first metal, such as nickel, and anodes 102 and 104 comprise a second metal, such as cobalt). These anodes 101-104 are placed on one or more sides 181-182 of a plating container 180 opposite the side(s) of the workpiece 120 that are to be plated, as illustrated in FIG. 1. If the anodes 101-104 are all connected to the same voltage source such that the same voltage (e.g., 100 volt %) is applied to each of them, then even though they are spaced apart a uniform current density and potential distribution will be exhibited within the plating bath in an area 140 adjacent to the workpiece 120, as evidenced by the uniform contours of relative differential voltage 110 within this area 140. For example, a current variability of only ~1.5% may be exhibited within the center region 140 of the bath 180 adjacent to the workpiece 120. This uniform current density and potential distribution results in a workpiece 120 with a uniform plated thickness. One advantage of this method is that the ratio of metals in the alloy plate can be selectively controlled by applying different voltages to anodes with different metal types. However, as illustrated in FIG. 2, applying one voltage (e.g., 100 volt %) to the first metal anodes 101 and 103 and another separate and different, voltage (e.g., 56 volt %) to the second metal anodes 102 and 104 typically causes an uneven current density and potential distribution within the plating bath 180 in the area 140 adjacent to the workpiece 120, as evidenced by the uneven contours of relative differential voltage 111 in this area 140. For example, a current variability of ~29% may be exhibited in the center region 140 of the plating bath 180 adjacent to the workpiece 120. This uneven current density and potential distribution results in both a greater overall alloy thickness and a non-uniform thickness as compared to the other alloy deposition methods. Consequently, if current density and potential distribution within the plating bath can be controlled, so can plating thickness.

Therefore, disclosed herein are embodiments 300, 700, 800 (see FIGS. 3*a-b*, 7 and 8, respectively) of an electroplating system and an associated electroplating method (see FIG. 9) that allow for depositing of metal alloys with a uniform plate thickness and with the means to alter dynamically the alloy composition (i.e., the ratio of two or more metals within the alloy). Specifically, by using multiple anodes, each with different types of soluble metals, the system and method avoid the need for periodic plating bath replacement and also allow the ratio of metals within the deposited alloy to be selectively and dynamically varied by applying different voltages to the different metals. The system and method further avoids the uneven current density and potential distribution and, thus, the non-uniform plating thicknesses exhibited by prior art methods by selectively varying the shape and placement of the anodes within the plating bath. Additionally, the system and method allow for fine tuning of the plating thickness by using electrically insulating selectively placed prescribed baffles.

More particularly, referring to the embodiments 300, 700 and 800 of FIGS. 3*a-b*, 7 and 8 in combination, each of the embodiments 300, 700 and 800 comprises a plating container 80 (i.e., an otherwise conventional plating tank) that is adapted to contain a plating solution (i.e., an otherwise conventional plating bath). The plating container 80 is further adapted to hold the workpiece 20 that is to be plated such that it is immersed within the plating solution 90.

The system further comprises a plurality of anode layers 50 adjacent to a wall (e.g., a first wall 81) in the plating container 80 opposite the side of the workpiece 20 that is to be plated (e.g., first side 21). These anode layers 50 provide the metal that forms the alloy plate on the side 21 of the workpiece 20. The system can further optionally comprise a plurality of additional anode layers 60 that are identical to the anode layers 50. The additional anode layers 60 are positioned on another wall (e.g., a second wall 82) in the container 80 that is opposite another side of the workpiece 20 (e.g., side 22) that is to be simultaneously plated. These additional anode layers 60 can similarly provide the metal that forms the alloy plate on the side 22 of the workpiece 20.

Figure 3B:
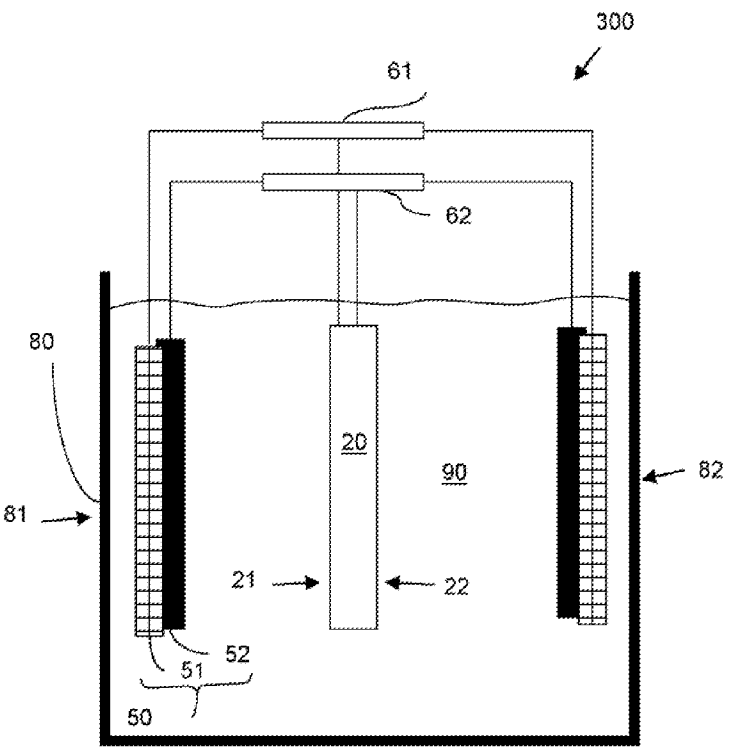
FIG. 3*b* is a cross-section view of the first embodiment illustrated in FIG. 3*a;*
Figure 3A:
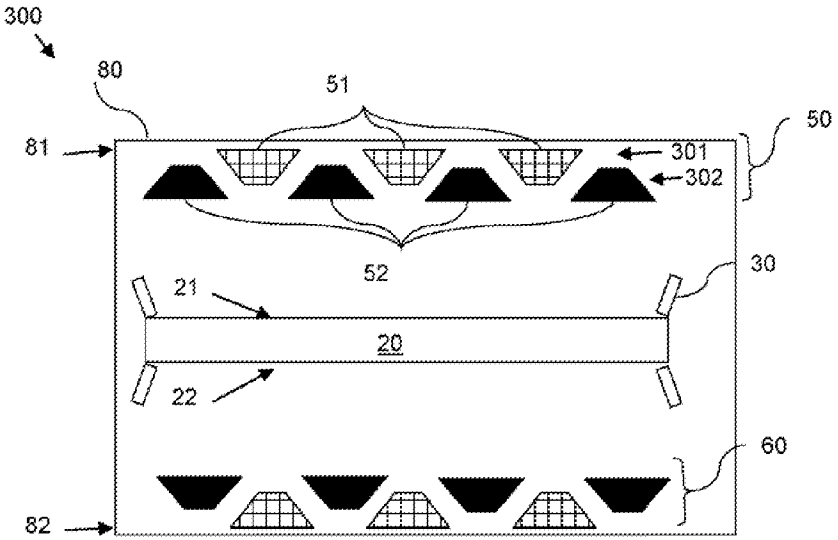
FIG. 3*a* is a top view schematic diagram illustrating a first embodiment of the alloy plating system of the invention.

The anode layers 50 in each embodiment 300, 700, and 800 comprise at least two different types of metal anodes (e.g., first anode(s) 51 comprising a first soluble metal (e.g., nickel), second anode(s) 52 comprising a second soluble metal 52 (e.g., cobalt), sometimes third anode(s) 53 comprising a third soluble metal, etc.). Each of the different types of anodes 51, 52, etc. are connected to different power sources in order to vary the alloy composition (i.e., the ratio of metals in the alloy plating). For example, as illustrated in FIG. 3*a*, first anode(s) 51 can be electrically connected to a first power source 61 so that they may receive a first voltage (e.g., 100 volt %), second anode(s) 52 can be electrically connected to a second power source 62 so that they may receive a second voltage (e.g., 56 volt %) that is different from the first voltage, etc. Furthermore, these anodes 51, 52 can comprise solid metal anodes and/or non-metal or non-soluble metal (e.g., titanium) baskets or similar containers that have a plurality of openings (e.g., mesh-type openings). An anode container can be filled with multiple pieces (e.g., spheres) of the selected soluble metal, for example, as discussed in U.S. Pat. No. 6,190,530 of Brodsky et al issued on Feb. 20, 2001 and incorporated herein by reference.

Figure 7:
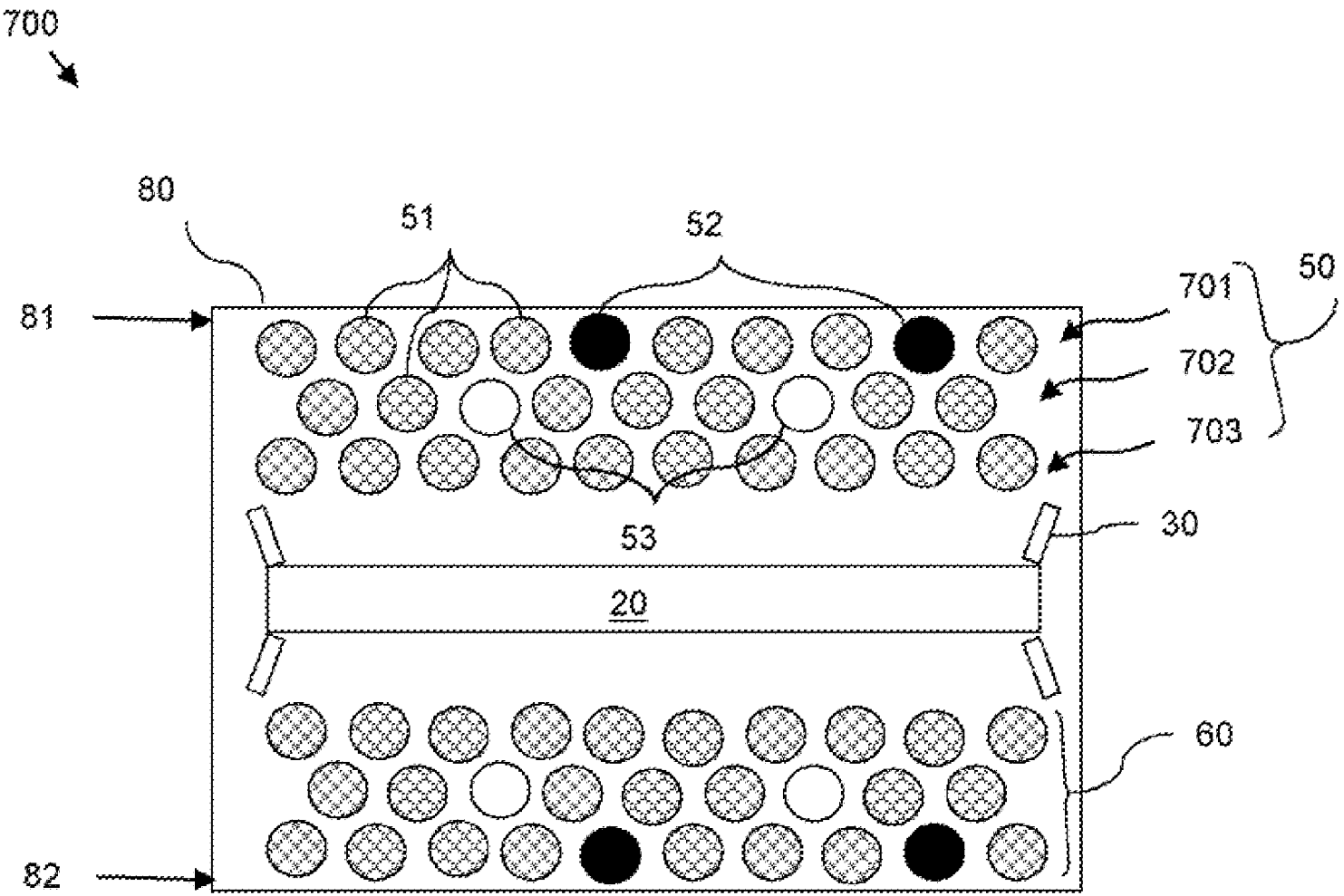
FIG. 7 is schematic diagram illustrating a second embodiment of the alloy plating system of the invention.

However, the embodiments 300, 700 and 800 differ from the prior art alloy plating methods and systems because the size, shape (i.e., the use of non-standard anode geometries), numbers, placement of the anodes 51, 52 within the plating bath 90, etc. are selectively varied. By selectively varying these features, a user can achieve the desired alloy composition and can simultaneously ensure an approximately uniform current density and potential distribution within the solution the area adjacent the workpiece in order to obtain a uniform plating thickness. The different embodiments 300, 700, and 800, as illustrated in FIGS. 3*a*, 7 and 8, respectively, vary based on the position and configuration of the anodes 51 and 52 within the anode layers 50.

Specifically, FIG. 3*a* represents a top view of one embodiment 300 of an alloy plating system. FIG. 3*b* represents a cross-section view of the embodiment 300. In this embodiment, anodes in the same layer comprise the same soluble metal, but the metal type may vary from layer to layer. For example, the anode layers 50 can comprise a first anode layer 301 with at least one first anode 51 comprising a first soluble metal (e.g., nickel) and a second anode layer 302 with at least one second anode 52 comprising a second soluble metal (e.g., cobalt), a third anode layer comprising at least one third anode comprising a third soluble metal, etc. The first anode layer 301 can be positioned adjacent to a first wall 81 of the container 80 and the second anode layer 302 can be positioned adjacent to the first anode layer 301 opposite the first wall 21 of the workpiece 20. Anodes in adjacent anode layers 301, 302 can overlap. For example, the anodes in each layer can be spaced apart at predetermined distance that is less than the width of an individual anode and the positions of the anodes in the second layer 302 can be offset from the positions of the anodes in the first layer 301 such that at least one side edge of each anode in the second layer overlaps a side edge of an anode in the first layer. Also shown in FIG. 3*a* is a selectively placed prescribed baffle 30 (see detailed discussion below regarding size and placement of baffles 30).

However, as mentioned above, the shapes, sizes, numbers, etc. of the anodes 51, 52 may vary based on the desired alloy composition (i.e., the desired ratio of metals in the alloy) and on the space available in the container 80. That is, based on various factors (including, for example, the desired alloy composition and the space available in the plating container 80), various anode features must be predetermined. These features include, for example, the relative surface areas of the different metals, the three dimensional shape of the anodes, the size of the anodes, the total number of anodes, the number of anode layers 50, the number of anodes in each layer 301, 302, etc. The size, shape and location of baffles 30 relative to the workpiece 20 can also be predetermined.

Figure 4:
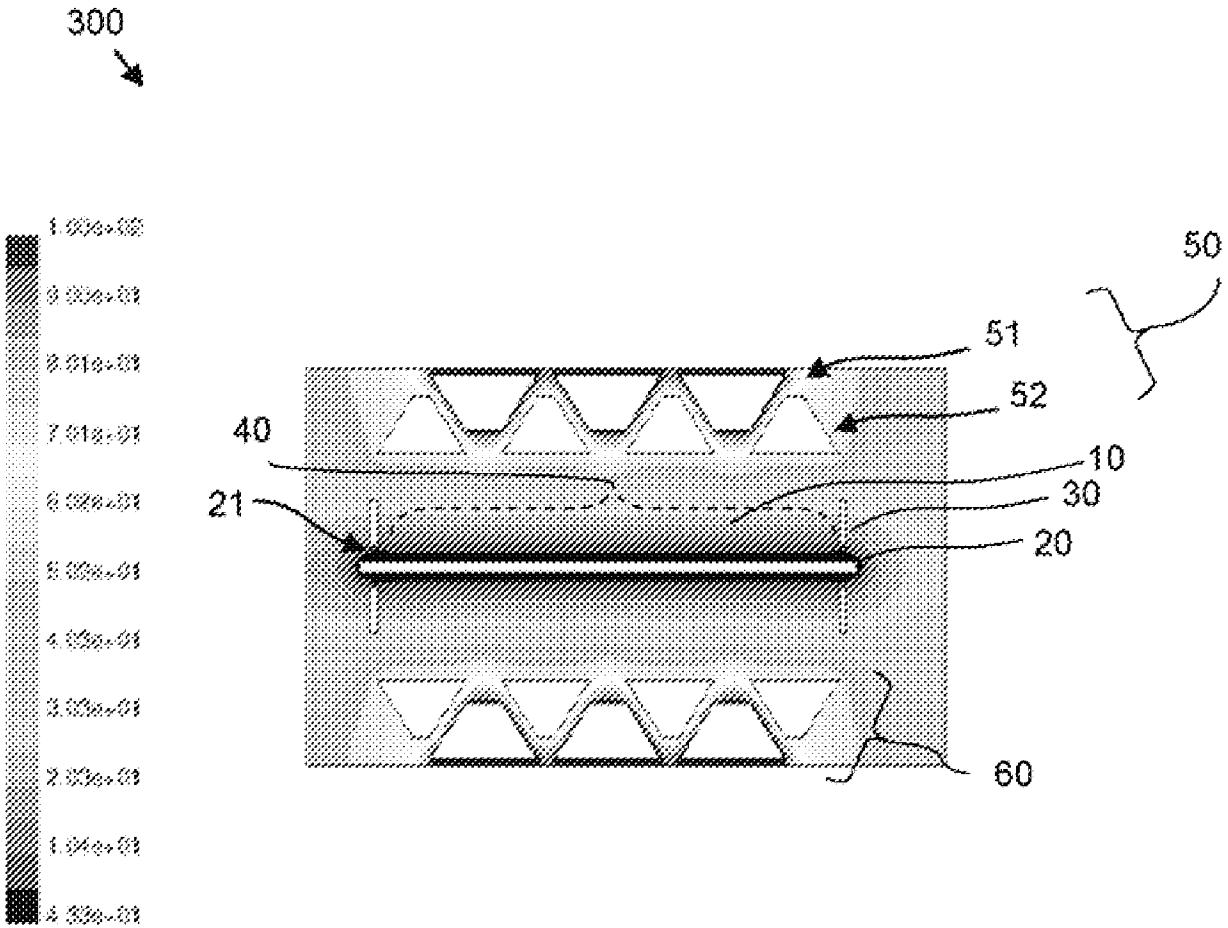
FIG. 4 is schematic diagram illustrating contours of relative differential voltage exhibited by the alloy plating system of FIG. 3*a* when different voltages are applied to different metal type anodes.
Figure 5C:
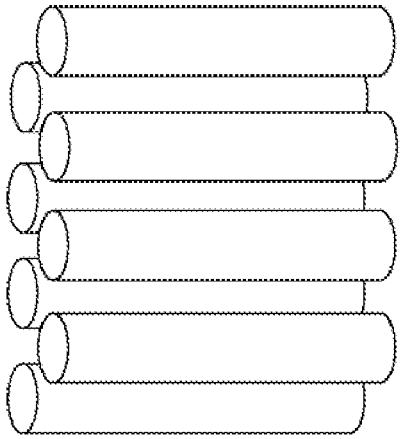
FIGS. 5*a-e* illustrate exemplary three-dimensional anode shapes and configurations that can be incorporated into the embodiments of the system of the invention.
Figure 5E:
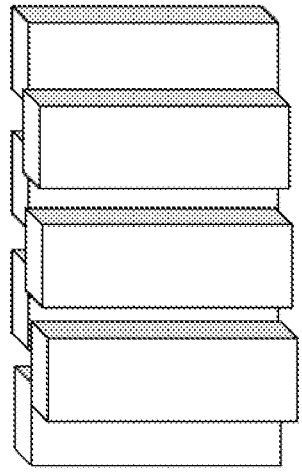
Figure 5B:
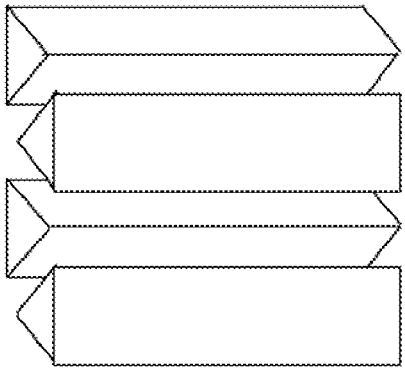
Figure 5D:
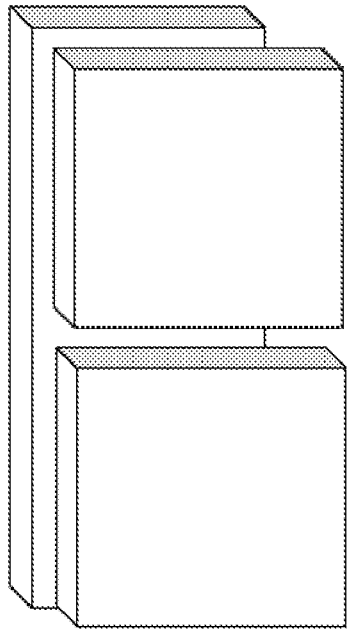
Figure 5A:
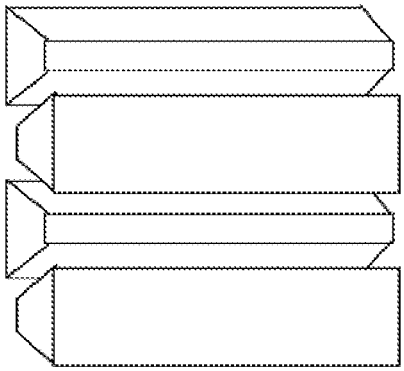

Specifically, the above-listed features are predetermined so that, when different voltages are applied during the plating process to the different anodes having different metals, the desired alloy composition is achieved and the current density and potential distribution remain approximately uniform within the solution. That is, referring to FIG. 3*a*, when a first voltage of 100 volt % is applied from the first current source 61 to the first anodes 51 with the first metal and a second different voltage is simultaneously applied to the second anodes 52 with the second metal from the second voltage source 62, the current density and potential distribution within the solution 90 in an area 40 adjacent to the first side 21 of the workpiece 20 will remain approximately uniform. This is evidenced by the uniform contours of relative differential voltage 10 in the area 40 (see FIG. 4). This uniform current density and potential distribution ensures that a uniform plating thickness is achieved (i.e., that variability of the plating thickness across the surface of the first side 21 of the workpiece is minimal). These predeterminations can, for example, be made using any commercially available Laplace equation solver to model the voltage and current distribution in the plating bath for a given set of baffles, anodes, and cathodes.

It should be noted that to match the experimental plated thickness data and to plate Ni—Co alloys, the model uses the electrolyte potential near the electrodes as boundary condition instead of using the electrode potential provided by the power source. This potential value is determined by measuring the potential with the use of a standard reference electrode such as Ag/AgCl or saturated calomel electrode (SCE) and a potentiostat or a very sensitive high impedance voltmeter at both the anode and cathode. Since the potential is related to current density, the potential must be determined for the range of current densities. This range can be easily measured by using standard electrochemical techniques. Thus, the surface area of the anode is a key factor in the modeling. This means that this technique is applicable to both solid soluble metal anodes and soluble pellet anodes in a basket. However, since the surface area will be different, this information will need to be known at the start of the design. This procedure is expected to work well with other plated alloys too where the current density is dependent of plating fluid geometry inside the plating tank.

Figure 6:
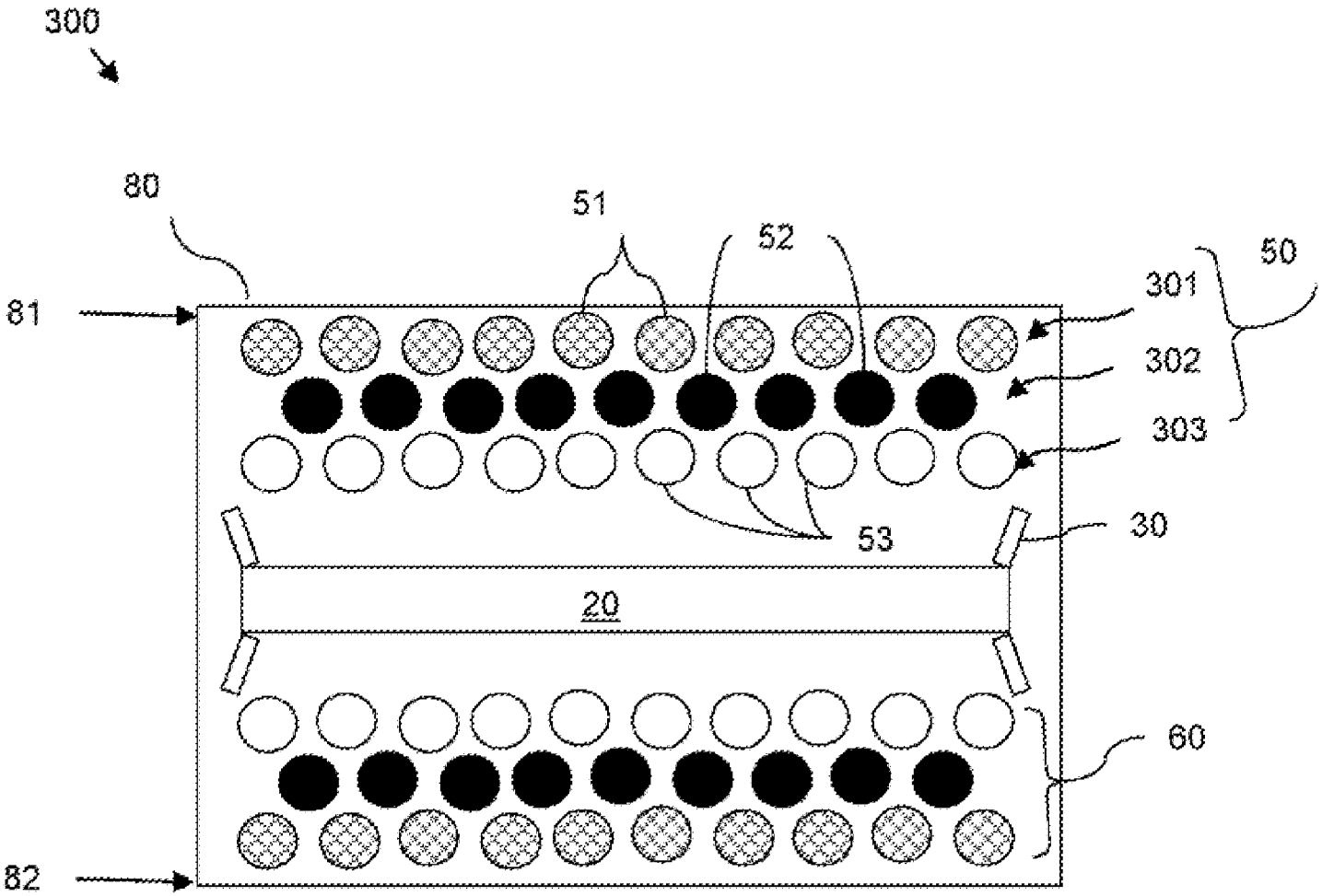
FIG. 6 is a schematic diagram further illustrating the first embodiment of the alloy plating system of the invention.

FIGS. 5*a-e* illustrate exemplary trapezoidal, triangular, rectangular and/or cylindrical three-dimensional anode shapes and configurations that may alternatively be incorporated into the above-described embodiment 300 of the alloy plating system as well as into any of the other embodiments 700 and 800. These shapes are only exemplary and not intended to be limiting. Thus, those skilled in the art will recognize that other suitable three-dimensional shapes and configurations may be incorporated into the embodiments 300, 700, and 800 of the alloy plating system. Additionally, those skilled in the art will recognize that the above-described embodiment 300 may alternatively incorporate more than two anode layers 50 and may also incorporate more than two metal types. For example, as illustrated in FIG. 6, the embodiment 300 may further comprise a third anode layer 303 between the second anode layer 302 and the workpiece 20. This third anode layer 303 can comprise at least one third anode 53 that comprises a third soluble metal. This third soluble metal can be the same or different from the first metal and/or the second metal of the first and second anodes 51, 52, respectively.

FIG. 7 represents another embodiment 700 of an alloy plating system. In this embodiment 700 each of the anode layers 50 can comprise multiple anodes and, specifically, can comprise multiple anodes with different types of soluble metals (i.e., first anodes 51 comprising a first soluble metal, second anodes 52 comprising a second soluble metal, third anodes 53 comprising a third soluble metal, etc.) dispersed throughout the anode layers 50. For example, one anode layer 701 can comprise first anode(s) 51 and second anode(s) 52. Another layer 702 can comprise first anode(s) 51 and third anode(s) 53. In yet another layer 703, all of the anodes can comprise the same soluble metal (e.g., can comprise first anodes 51).

As with the previously described system embodiment, the anodes in adjacent anode layers 50 overlap. That is, the anodes in each layer 701-703 can be spaced apart a predetermined distance that is less than the width of an individual anode and the positions of the anodes in the second layer 702 can be offset from the positions of the anodes in the first layer 701, the positions of the anodes in the third layer 703 can be offset from the positions of the anodes in the second layer 702, etc. Furthermore, as mentioned above, the shapes, sizes, numbers, etc. of the anodes 51, 52 may vary based on the desired alloy composition and on the space available in the container 80. That is, based on the desired alloy composition and on the space available in the container 80, various predeterminations are made. These predeterminations can include, but are not limited to, the relative surface areas of the different metals i.e., of the first metal and the second metal), the three dimensional shape of the anodes (e.g., trapezoidal, triangular, rectangular and/or cylindrical three-dimensional shapes, see FIGS. 5*a-e*), the size of the anodes, the total number of anodes, the number of anode layers 50, the number of anodes of each metal type in each layer, etc. The size, shape and position of baffles 30 relative to the workpiece 20 are also determined. These predeterminations are made so that when different voltages are applied to the different anodes 51, 52, 53, etc. during the plating process, the desired alloy composition is achieved and the current density and potential distribution remain approximately uniform within the solution in an area adjacent to the first side of the workpiece to ensure a uniform plating thickness. Again, these predeterminations can be made using any commercially available Laplace equation solver to model the voltage and current distribution in the plating bath for a given set of baffles, anodes, and cathodes.

Figure 8B:
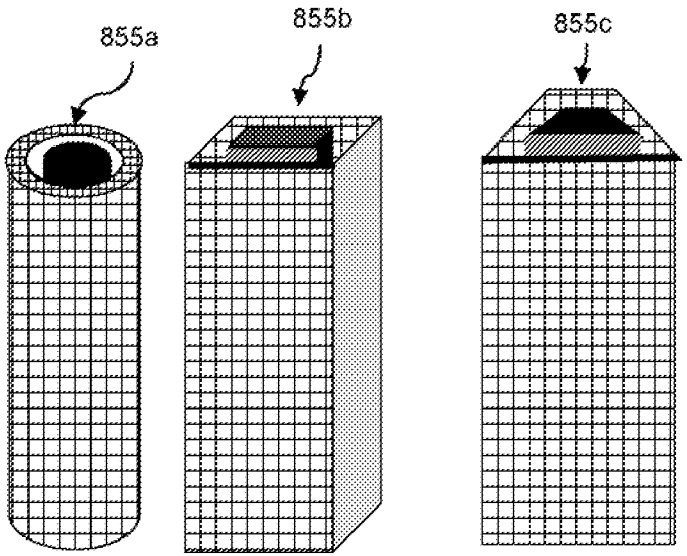
FIG. 8*b* illustrates exemplary multi-anode structures that may be incorporated into the third embodiment of the alloy plating system of the invention.
Figure 8A:
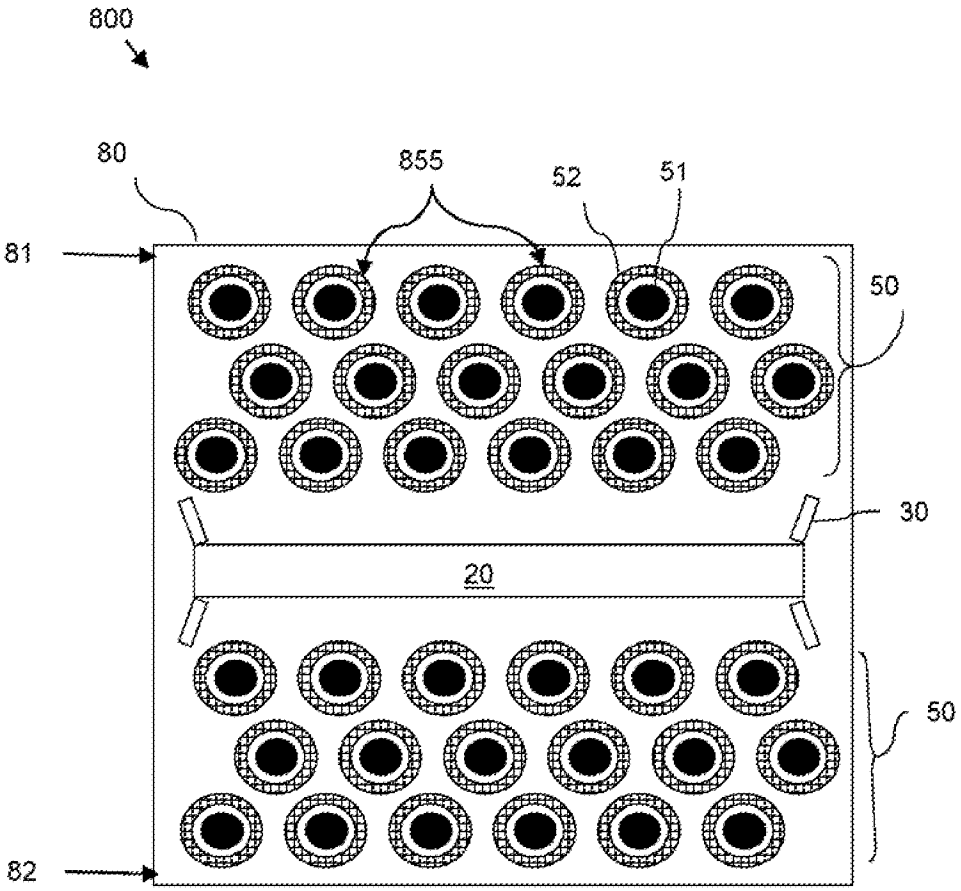
FIG. 8*a* is schematic diagram illustrating a third embodiment of the alloy plating system of the invention.

FIG. 8*a* represents another embodiment 800 of an alloy plating system. In this embodiment 800 each of the anode layers 50 can comprise a plurality of multi-anode structures 855. Each multi-anode structure can comprise at least two different anodes comprising different types of soluble metals. Specifically, each multi-anode structure 855 can comprise a first anode 51 that comprises a first soluble metal (e.g., nickel) and that is surrounded by a second anode 52 that comprises a second soluble metal (e.g., cobalt) that is different from the first soluble metal (e.g., see shapes of exemplary multi-anode structures depicted in FIG. 8*a*). In this embodiment the first and second anodes 51, 52 can each comprise either non-metal or non-soluble metal (e.g., titanium) baskets or similar type containers with a plurality of openings (e.g., mesh-type openings). The basket of the first anode 51 is filled with pieces (e.g., spheres) of the first soluble metal and is nested within the basket of the second anode 52 which is further filled with pieces (e.g., spheres) of the second soluble metal. The multi-anode structure 855 adjacent anode layers 50 overlap. That is, the multi-anode structures 855 in each layer can be spaced apart a predetermined distance that is less than the width of the individual multi-anode structures and the positions of the structures in the adjacent layers can be offset. Furthermore, as with the previously described embodiments, based on the desired alloy composition and on the space available in the container, various anode features are predetermined. These features include, but are not limited to, the relative surface areas of the different metals, the three dimensional shape of the multi-anode structures 855 (e.g., trapezoidal, triangular, rectangular and/or cylindrical three-dimensional shapes, see FIG. 8*b*) and, specifically, the shapes of the first and second anodes within the structures, the relative sizes of the first and second anodes 51, 52, the total number of multi-anode structures 855, the number of anode layers 50, the number of multi-anode structures 855 in each layer, etc. The size, shape and position of baffles 30 relative to the workpiece 20 are also determined. These predeterminations are specifically made so that, when different voltages are applied to the different anodes 51, 52, during the plating process, the desired alloy composition is achieved and the current density and potential distribution remain approximately uniform within the solution in an area adjacent to the first side of the workpiece to ensure a uniform plating thickness. Again, these predeterminations can be made using any commercially available Laplace equation solver to model the voltage and current distribution in the plating bath for a given set of baffles, anodes, and cathodes.

As mentioned above, each of the above-described embodiments 300, 700, 800 can comprise at least one baffle 30 in the plating container 80 adjacent to the workpiece 20. The baffle(s) 30 can comprise a dielectric material and can be configured so that their size, shape and position within the container 80 relative to the workpiece 20 is selected to enable current flux control (i.e., to maximize current density control) over the workpiece 20 surface. Once the size, shape and location of the prescribed baffles are determined, they can be placed permanently in the plating bath tank. Alternatively, they can be mounted on the structure that supports the workpiece 20 when placed inside the plating tank. Optimizing the sizes, shapes and positions of the baffles, allows for fine tuning of the uniform current density and potential distribution in the solution in the area adjacent to the workpiece so as to selectively vary the overall plating thickness distribution.

Figure 9:
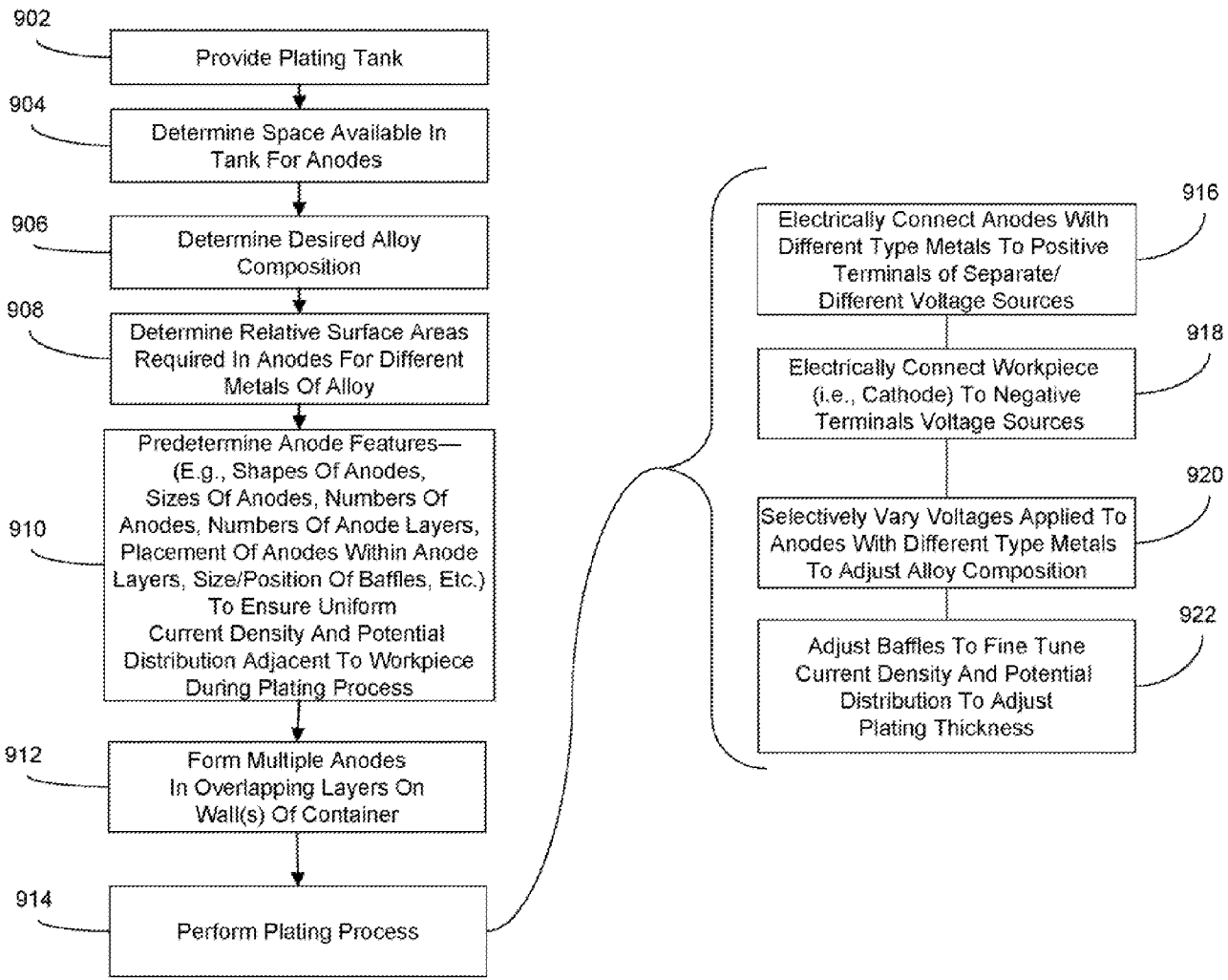
FIG. 9 is a flow diagram illustrating embodiments of the alloy plating method of the invention.

Referring to FIG. 9, also disclosed are embodiments of associated methods for uniform plating of a workpiece with an alloy of two or more metals. The embodiments comprise providing a plating container (i.e., an otherwise conventional plating tank) that is adapted to contain a plating solution (i.e., an otherwise conventional plating bath) as well as to hold the workpiece that is to be plated within the solution (902).

Then, a determination is made regarding the space available in the tank, for the anodes, based on both the size of the tank and the sizes of the workpiece (904). A determination is also made regarding the desired alloy composition (i.e., the desired ratio of metals (e.g., nickel and cobalt) in the alloy plate (906). Then, based on the desired alloy composition, a determination is made regarding the relative surface areas required in the anodes for the different metals of the alloys (980). Net, based on the space available in the tank, on the desired alloy composition and on the required relative surface areas, predeterminations are made regarding various features of the anodes that are to be placed in the tank (910). These predeterminations can include, but are not limited to, one or more of the following: (1) the three dimensional shape of the anodes (e.g., trapezoidal, triangular, rectangular and/or cylindrical three-dimensional shapes, as illustrated in FIGS. 5*a-e*);

(2) the relative number of anodes with different types of metals (e.g., the number of first anodes comprising a first soluble metal, second anodes comprising a second soluble metal, etc.); (3) the configurations of the anodes (e.g., single anode structures (e.g., as illustrated in embodiments 300 and 700, described above) or multi-anode structures (e.g., as illustrated in embodiment 800, described above); (4) the sizes of the anodes; (6) the number of anode layers; the numbers of different types of anodes in each layer; (7) the positions of the different types of anodes within each of the layers, etc. The need to use baffles around the cathode to improve the current density distribution over the cathode surface must also be determined in this stage of the process. That is, the size, shape and location of the baffles relative to the workpiece can also be predetermined.

The above-mentioned features are specifically predetermined so that during a subsequent plating process (see process 914 below) when different voltages are applied to the different types of anodes (e.g., when a first voltage is applied to the first anode(s) that comprise a first soluble metal and a second voltage is applied to the second anode(s) that comprise a second soluble metal, etc.), the desired alloy composition is achieved and current density and potential distribution remain approximately uniform in the solution in an area adjacent to the first side of the workpiece to ensure a uniform plating thickness. These predeterminations can, for example, be accomplished using a standard Laplace equation solver with modified boundary conditions, as described above, to model the voltage and current distribution in the plating bath for a given set of baffles, anodes, and cathodes.

Then, based on these predeterminations, baffles, multiple anodes (e.g., first anodes comprising the first soluble metal (e.g., nickel) and second anodes comprising the second soluble metal (e.g., cobalt) are formed in overlapping layers in the container adjacent to a one or more of the container walls (912). For example, depending upon the space available in the tank, the desired alloy composition and on the required relative surface areas, all anodes in the same layer can comprise the same soluble metal with the metal type varying from layer to layer (e.g., as illustrated in embodiment 300 of FIG. 3*a*, described above) or anodes comprising different soluble metals can be dispersed throughout the anode layers (e.g., as illustrated in embodiment 700, described above). Alternatively, each layer can comprise a plurality of multi-anode structures, where each multi-anode structure comprises at least two different soluble metals (e.g., as illustrated in embodiment 800, described above).

Once the anodes are formed in the plating tank at process 912, the plating process can be performed (914). Specifically, each of the anodes with different types of metals can be electrically connected to the positive terminal, of separate/different voltage sources (916). For example, as illustrated in FIG. 3*b*, first anodes 51 that comprise a first metal can be connected to a first voltage source 61, second anodes 52 that comprise a second metal can be connected to a second voltage source 62, etc. The workpiece 20 (i.e., the cathode) can be electrically connected to the positive terminals of these voltage sources 61, 62 (918). Thus, a circuit is created. Then, voltages can be simultaneously applied from the voltage sources to the anodes 51, 52 causing an electrical current to pass through the solution 90 and, thereby, causing metal ions from the different metal type anodes 51, 52 to take up excess electrons at the workpiece 20 such that an alloy layer of the metals is formed on the workpiece 20. The embodiments of the method can further comprise selectively and, optionally, dynamically varying the different voltages applied to the different anodes so as to selectively vary the ratio of the first metal to the second metal in the alloy being deposited on the workpiece (920). Additionally, the embodiments of the method can further comprise fine tuning the current density and potential distribution in the solution in the area adjacent to the workpiece using selectively placed prescribed baffles (922). This fine tuning can be done to control the overall thickness of the uniformly deposited plating.

It should be understood, by those skilled in the art, that some of the modifications to the plating bath geometry described herein would also apply to pulse plating, reverse pulse plating and reverse plating processes, also known as electro-etch. It should further be understood, by those skilled in the art, that the operation of the power supplies in voltage control mode, current control mode or dual control mode apply.

Therefore, disclosed above are embodiments of an electroplating system and an associated electroplating method that allow for depositing of metal alloys with a uniform plate thickness and with the means to alter the alloy composition. Specifically, by using multiple anodes, each with different types of soluble metals, the system and method avoid the need for periodic plating bath replacement and also allow the ratio of metals within the deposited alloy to be selectively varied dynamically by applying different voltages to the different metals. The system and method further avoid the uneven current density and potential distribution and, thus, the non-uniform plating thicknesses exhibited by prior art methods by selectively varying the shape and placement of the anodes within the plating bath. Additionally, the system and method allow for fine tuning of the plating thickness by using electrically insulating selectively placed prescribed baffles.

The alloy electroplating system and method disclosed above provides several other advantages. Specifically, it enables a path to selectively define the anode shape for any typical product surface shape and to accommodate prescribed non-constant compositions and/or thicknesses as well as specialized plated alloy finishes. It can be used in packaging and silicon chip processing and further that it is applicable to other products and/or transient processes. It reduces the costs associated with alloy plating by reducing the required rate at which the plating bath must be disposed of and replaced. Finally, it improves the quality of the alloy plating with time by reducing the use of organics, such as stress reducers, as the metals level increase in the plating bath prior to dumping. These organics eventually build up in the bath and effect the surface topography which can impact product performance. Furthermore, it should be noted that other current density control methods applicable to this disclosure and using the described novel anode arrangement include synchronous and asynchronous pulsing current profiles, direct and reverse potential biasing, surface area ratio of anodes to reduce voltage differential, electroetching of metals, etc.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, those skilled in the art will recognize that these embodiments can be practiced with modification within the spirit and scope of the appended claims.

What is claimed is:

1. A system for plating a workpiece, said system comprising:

a container adapted to contain a solution and said workpiece within said solution;

a first anode layer comprising a single first anode adjacent to a first wall in said container, said first anode comprising a first metal; and a second anode layer in said container adjacent to said first anode layer, said second anode layer comprising a plurality of discrete second anodes, said second anodes comprising a soluble second metal that is different from said first metal and each second anode being smaller than said first anode and further being positioned laterally between said first anode and said workpiece.

2. The system of claim 1, wherein, based on space available in said container and on a desired alloy composition, relative surface areas of said first metal and said second metal and a three dimensional shape of said first anode and said second anodes are predetermined, and wherein said relative surface areas and said three dimensional shape are predetermined so that when different voltages are applied to said first anode and to said second anodes, respectively, current density and potential distribution will remain approximately uniform within said solution in an area adjacent to a first side of said workpiece.

3. The system of claim 1, further comprising at least one baffle in said container adjacent to said workpiece, said baffle comprising a dielectric material and a size of said baffle and a position of said baffle within said container relative to said workpiece being predetermined so as to fine tune a current density and potential distribution in said solution in an area adjacent to said workpiece.

4. The system of claim 1, said first anode and said second anodes each comprising one of a solid electrolytic metal and a basket filled with multiple pieces of a soluble metal.

5. The system of claim 1, said first anode and said second anodes each having a three-dimensional shape, said three-dimensional shape being rectangular.

6. The system of claim 1, further comprising a plurality of additional anode layers adjacent to a second wall in said container, said second wall being opposite said first wall.

7. The system of claim 1, further comprising a third anode layer comprising a plurality of discrete third anodes, said third anodes overlapping said second anode layer such that at least a portion of each third anode is positioned laterally between a portion of each second anode and said workpiece.

8. The system of claim 1, further comprising a third anode layer comprising a plurality of discrete third anodes, said third anodes overlapping said second anode layer such that at least a portion of each third anode is positioned laterally between a portion of each second anode and said workpiece.

9. A system for plating a workpiece, said system comprising:

a container adapted to contain a solution and said workpiece within said solution;

a first anode layer adjacent to a first wall in said container; and a second anode layer in said container adjacent to said first anode layer, said first anode layer and said second anode layer each comprising multiple discrete anodes, said anodes in said first anode layer and said second anode layer being offset and spaced an approximately uniform distance apart and said uniform distance being less than a width of said anodes such that each anode in said first anode layer has at least a first side edge that is overlapped by a second side edge of one of said anodes in said second anode layer, and at least one of said first anode layer and said second anode layer comprising at least one first anode comprising a first metal and at least one second anode comprising a second metal that is different from said first metal.

10. The system of claim 9, wherein, based on space available in said container and on a desired alloy composition, relative surface areas of said first metal and said second metal and a three dimensional shape of said multiple anodes are predetermined, and wherein said relative surface areas and said three dimensional shape are predetermined so that when different voltages are applied to said at least one first anode and to said at least one second anode, respectively, current density and potential distribution will remain approximately uniform within said solution in an area adjacent to a first side of said workpiece.

11. The system of claim 9, one of said first anode layer and said second anode layer further comprising at least one third anode comprising a third metal that is different from said first metal and said second metal.

12. The system of claim 9, further comprising at least one baffle in said container adjacent to said workpiece, said baffle comprising a dielectric material and a size of said baffle and a position of said baffle within said container relative to said workpiece being predetermined so as to fine tune a current density and potential distribution in said solution in an area adjacent to said workpiece.

13. The system of claim 9, said at least one first anode and said at least one said second anode each comprising one of a solid electrolytic metal and a basket filled with multiple pieces of a soluble metal.

14. The system of claim 9, said multiple discrete anodes each having three-dimensional shape, said three-dimensional shape being one of trapezoidal, triangular, rectangular and cylindrical.

15. The system of claim 9, further comprising a plurality of additional anode layers adjacent to a second wall in said container.

16. A system for plating a workpiece, said system comprising:

a container adapted to contain a solution and said workpiece within said solution;

a first anode layer comprising a plurality of discrete first anodes adjacent to a first wall in said container, said first anodes comprising a first metal; and a second anode layer adjacent to said first anode layer in said container, said second anode layer comprising a plurality of discrete second anodes, said second anodes comprising a second metal that is different from said first metal, being offset from said first anodes, and being spaced an approximately uniform distance apart, said uniform distance being less than a width of said first anodes such that each first anode in said first anode layer has a first side edge that is overlapped by a second side edge of one of said second anodes in said second anode layer.

17. The system of claim 16, wherein, based on space available in said container and on a desired alloy composition, relative surface areas of said first metal and said second metal and a three-dimensional shape of said first anodes and said second anodes are predetermined, and wherein said relative surface areas and said three dimensional shape are predetermined so that when different voltages are applied to said first anodes and to said second anodes, respectively, current density and potential distribution will remain approximately uniform within said solution in an area adjacent to a first side of said workpiece.

18. The system of claim 16, further comprising at least one baffle in said container adjacent to said workpiece, said baffle comprising a dielectric material and a size of said baffle and a position of said baffle within said container relative to said workpiece being predetermined so as to fine tune a current density and potential distribution in said solution in an area adjacent to said workpiece.

19. The system of claim 16, said first anodes and said second anodes each comprising one of a solid electrolytic metal and a basket filled with multiple pieces of a soluble metal and each having a three-dimensional shape, said three-dimensional shape being one of trapezoidal, triangular, rectangular and cylindrical.

20. The system of claim 16, further comprising a plurality of additional anode layers adjacent to a second wall in said container, said second wall being opposite said first wall.

* * * * *